US007221246B2

(12) United States Patent
Rajauria et al.

(10) Patent No.: US 7,221,246 B2
(45) Date of Patent: May 22, 2007

(54) SPLIT ROTOR SYSTEM AND METHOD WITH SPRINGS

(75) Inventors: Samir Rajauria, Agra (IN); Wolfgang Meyer-Haack, Neumunster (DE); Janakiraman Narayanan, Chennai (IN); Sanjoy Bhattacharjee, Kolkata (IN); Hemant Anjaria, Mumbai (IN); Praveenkumar Verma, Mumbai (IN)

(73) Assignee: General Electric Company, Schenectady, NY (US)

( * ) Notice: Subject to any disclaimer, the term of this patent is extended or adjusted under 35 U.S.C. 154(b) by 40 days.

(21) Appl. No.: 10/905,513

(22) Filed: Jan. 7, 2005

(65) Prior Publication Data

US 2006/0152308 A1 Jul. 13, 2006

(51) Int. Cl.
*H01H 75/00* (2006.01)

(52) U.S. Cl. ..... 335/16; 335/195

(58) Field of Classification Search ..... 335/16, 335/147, 195, 165–176; 218/22
See application file for complete search history.

(56) References Cited

U.S. PATENT DOCUMENTS 4,910,485 A * 3/1990 Bolongeat-Mobleu et al. ... 335/195
5,030,804 A * 7/1991 Abri ..... 200/323
6,259,048 B1 * 7/2001 Castonguay et al. ..... 200/244
6,366,438 B1 4/2002 Bauer
6,396,369 B1 5/2002 Schlitz et al.
6,791,440 B2 * 9/2004 Harmon et al. ..... 335/16
6,965,292 B2 * 11/2005 Ciarcia et al. ..... 337/50

FOREIGN PATENT DOCUMENTS

EP 0314540 A1 11/1988

* cited by examiner

*Primary Examiner*—Elvin Enad
*Assistant Examiner*—Bernard Rojas
(74) *Attorney, Agent, or Firm*—Cantor Colburn LLP

(57) ABSTRACT

A rotor assembly may include first rotor half, a first spring supported with the first rotor half, a second rotor half, and a second spring supported within the second rotor half, wherein the first rotor half and the second rotor half are adjoined to enclose the first and second springs. A coiled section of each spring may surround a rotor center pin. A contact arm positioned between the springs may include a non-circular opening. A method for assembling such a rotor assembly is further described.

20 Claims, 5 Drawing Sheets

SPLIT ROTOR SYSTEM AND METHOD WITH SPRINGS

BACKGROUND OF THE INVENTION

The present disclosure relates generally to a contact assembly, and particularly to a rotor assembly for a contact assembly.

Contact pairs are commonly arranged upon one movable rotary contact arm. When an overcurrent condition exists, electromagnetic forces cause the rotary contact arm to separate from fixed contacts against the closing force of one or more contact springs.

The rotary contact arm is typically connected to the contact springs via pivotal links. During quiescent operation, the contact springs provide a force to the rotary contact arm via the links in a direction as to drive the rotary contact arm into the fixed contacts. Upon short circuit condition, for example, current levels at or above the "withstand level" of the interrupter, the electromagnetic forces generated between the fixed contacts and the rotary contact arm causes the rotary contact arm to rotate away from the fixed contacts. If the overcurrent level reaches or exceeds the "let-through level", the spring force passes a point commonly referred to as the "overcenter" position and the rotational direction of the contact spring force changes, i.e., the contact springs provide a force to the rotary contact arm via the links in a direction as to drive the rotary contact arm apart from the fixed contacts.

The rotary assemblies of prior systems use compression springs to provide the spring force. Compression springs are coiled helical springs that resist a compressive force applied axially. Such rotary assemblies are designed such that assembly time is high, and does not meet top-down assembly criteria. Furthermore, these systems require complex assembly jigs and fixtures.

BRIEF DESCRIPTION OF THE INVENTION

Embodiments of the invention include a rotor assembly including a first rotor half, a first spring supported with the first rotor half, a second rotor half, and a second spring supported within the second rotor half, wherein the first rotor half and the second rotor half are adjoined to enclose the first and second springs.

Other embodiments include a method for assembling a rotor assembly, the method including arranging a first rotor half with an inner side exposing a central recess, placing a coiled section of a first spring within the central recess, inserting a rotor center pin within the central recess and through the coiled section of the first spring, threading an opening of a contact arm over the rotor center pin, threading a coiled section of a second spring over the rotor center pin, and placing a central recess of the second rotor half over the rotor center pin.

Other embodiments include a contact assembly including a first fixed contact, a second fixed contact, a contact arm having a first end, a second end, and a central portion, a first movable contact attached to the first end of the contact arm and movable in and out of engagement with the first fixed contact, a second movable contact attached to the second end of the contact arm and movable in and out of engagement with the second fixed contact, an opening within the central portion of the contact arm, wherein the opening has a length that is longer than its width, and a center rotor pin passing through the opening, wherein the contact arm is rotatable about the center rotor pin, wherein, when non-uniform erosion of any of the fixed or movable contacts occurs, the opening allows for re-alignment of the contact arm about the center rotor pin for ensuring uniform contact pressure between the first fixed and movable contacts and between the second fixed and movable contacts.

BRIEF DESCRIPTION OF THE DRAWINGS

Referring to the exemplary drawings wherein like elements are numbered alike in the accompanying FIGS..

DETAILED DESCRIPTION OF THE INVENTION

An embodiment of the invention provides a split rotor with spring, to reduce friction, in a double break arrangement and having a top down assembly in the manufacturing which, in result, will reduce the assembly time in an automated system. This system is accomplished through the development of a contact arrangement for a frame breaker, with fewer components and less assembly time to reduce the cost of the breaker. Thus, a double contact rotor system is provided that will deliver equal contact force regardless of contact wear, electrical isolation from adjacent electrical phases and few parts for ease of manufacture. In result, the whole pole enclosure assembly is a top down assembly.

Figure 1:
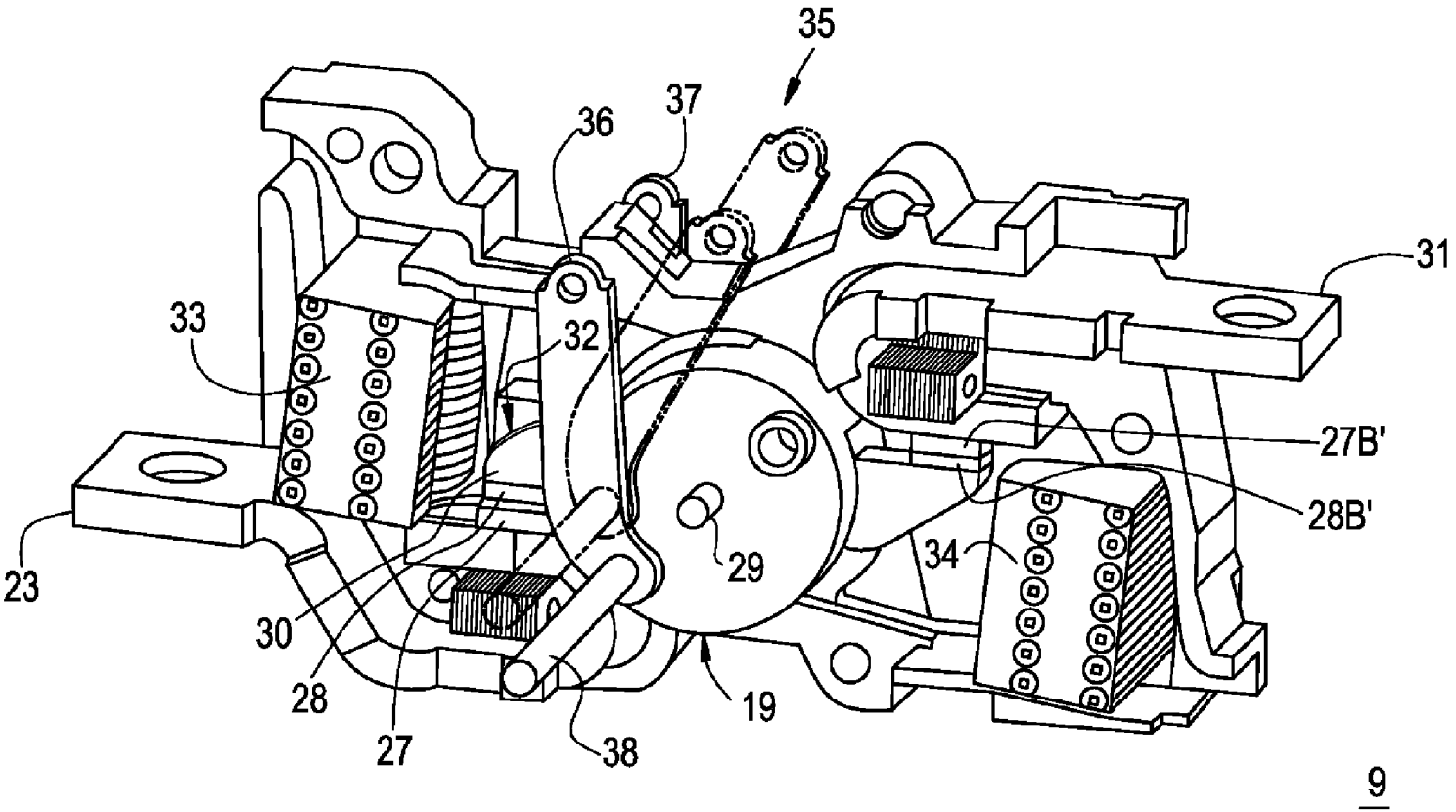
FIG. 1 depicts a front perspective view of an exemplary circuit breaker rotary contact assembly for employing the split rotor system with springs.

FIG. 1 shows an exemplary circuit breaker rotary contact assembly 10 that may employ the split rotor with spring. While only one embodiment of a circuit breaker rotary contact assembly 9 is shown, it should be understood that the split rotor with spring may be utilized in alternate embodiments of a circuit breaker rotary contact assembly. The circuit breaker rotary contact assembly 9 may include opposing line and load straps 23, 31 adapted for connection with an associated electrical distribution system and a protected electric circuit. Fixed contacts 27, 27B' connect with the line and the load straps while the moveable contacts 28, 28B' are attached to the ends 30 of moveable contact arms 32 for making moveable connection with the associated fixed contacts to complete the circuit connection with the line and load straps 23, 31. The movable contact arms 32 may be of unitary structure and rotate within the rotor and contact arm assembly 19 about the contact arm pivot 29 when rotated upon response to the circuit breaker operating mechanism (not shown) by connection via the pins 38 and the pair of opposing levers 36, 37, shown generally by item 35. The arcs generated when the contacts 27B', 28B' and 27, 28 are separated upon overload circuit current conditions are cooled and quenched within the arc chambers 33, 34 to interrupt current through the protected circuit. It should be noted that other conditions may also cause the contacts to separate other than overload conditions. The rotor 19 may rotate about a rotor pivot in response to the circuit breaker operating mechanism and interacts with the moveable contact arms 32.

Figure 2:
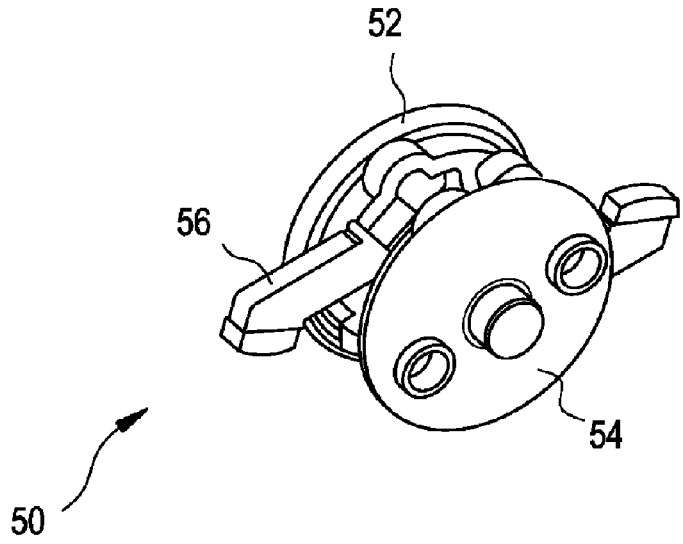
FIG. 2 depicts a front perspective view of an exemplary assembled rotor system.

Turning now to FIG. 2, an assembled rotor assembly 50 is shown. The rotor assembly 50 may be used within a contact assembly such as shown in FIG. 1 or within any contact assembly or other mechanism that utilizes a rotor assembly having a double break contact arm, that is, a contact arm having a movable contact on each arm end. The rotor assembly 50 may include a first rotor half 52 and a second rotor half 54. The first rotor half 52 and the second rotor half 54 support the contact arm 56 therebetween.

Figure 3:
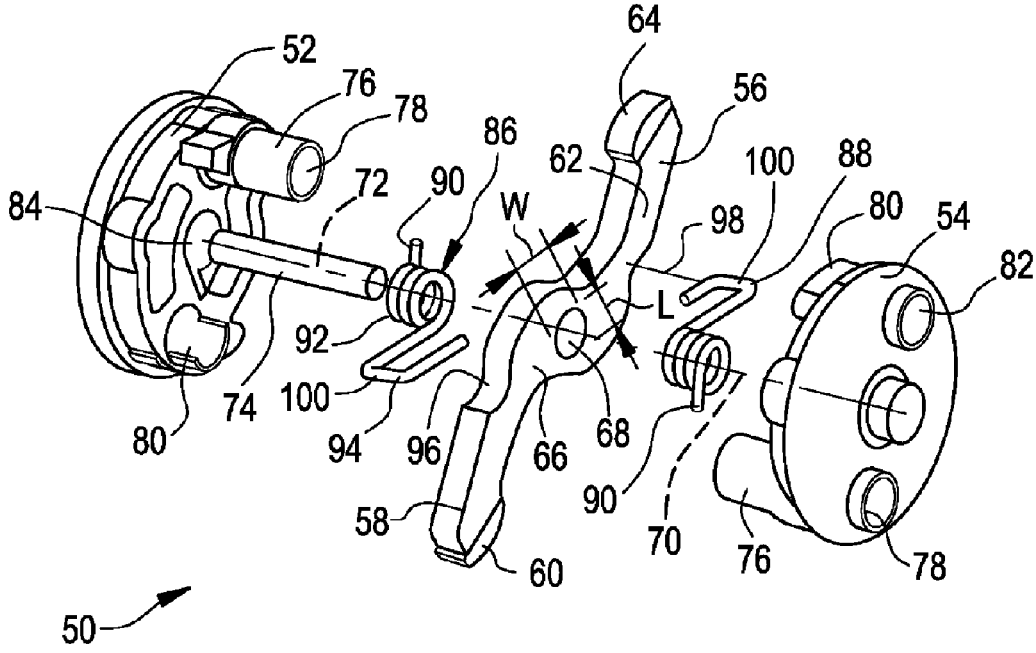
FIG. 3 depicts an exploded view of the rotor system of FIG. 1.

With further reference to FIG. 3, the contact arm 56 may include a first end 58 that supports a first movable contact 60, and a second end 62 that supports a second movable contact 64. By a "movable contact", it should be understood that the contacts 60, 64 are not movable with respect to the contact arm 56, but instead move with the contact arm 56 as the contact arm 56 is moved to engage the contacts 60, 64 with a respective pair of fixed contacts within a circuit breaker or as the contact arm 56 is moved to separate the contacts 60, 64 from the fixed contacts. The contact arm 56 may further include a central portion that connects the first end 58 to the second end 62. Within the central portion 66, there may be an opening 68 which may be oblong in shape. Although an oblong shape is described, it should be understood that various other shapes may also successfully achieve the below-described functions, such as rectangular, elliptical, or diamond shapes. The opening 68 is shaped so that the contact arm 56 shares an axis of rotation 70 with a longitudinal axis 72 of a rotor center pin 74. Also, the opening 68 may be shaped to have a length L which is measured to be parallel to a line that perpendicularly intersects a contacting face of the movable contacts 60, 64, and a width W which is measured to be parallel to a line that is parallel with a contacting face of the movable contacts 60, 64. The width W may be smaller than the length L, where the width W of the opening 68 is the distance from a first side of the opening 68 closest to the first end 58 to a second side of the opening 68 closest to the second end 62. Thus, the length L of the opening 68 is the distance from a third side of the opening 68 that connects one end of the first side of the opening 68 to one end of the second side of the opening 68 to a fourth side of the opening 68 that connects another end of the first side of the opening 68 to another end of the second side of the opening 68. By "side" of an opening 68, it should be understood that such a side may be curved, pointed, straight, etc., depending on the shape of the opening 68.

The first rotor half 52 and second rotor half 54 may each include a protrusion 76, each protrusion including a longitudinal aperture 78, where each longitudinal aperture 78 has a longitudinal axis that is parallel with the longitudinal axis of the rotor center pin 74. The first rotor half 52 and the second rotor half 54 may also each include a receiving portion 80, each receiving portion 80 including a longitudinal aperture 82, where each longitudinal aperture 82 may have a longitudinal axis that is parallel with the longitudinal axis of the rotor center pin 74. When assembled, the protrusion 76 of the first rotor half 52 may be received within the receiving portion 80 of the second rotor half 54, and the protrusion 76 of the second rotor half 54 may be received within the receiving portion 80 of the first rotor half 52. Thus, the longitudinal apertures 78 may combine with the longitudinal apertures 82 to form a pair of passageways through the rotor assembly 50. Such passageways may be used for allowing for a link connection by means of an extended rotor pin or driving pin (not shown) with the circuit breaker operating mechanism, via mechanism links, to allow manual intervention for opening and closing the circuit breaker contacts. These pins may also be used to connect adjacent rotor assemblies, and to connect the contact assembly with the operating mechanism for normal operations. The passageways, and thus the protrusions 76 and receiving portions 80, may be diametrically opposed, although other configurations that are found useful within a circuit breaker would also be within the scope of this rotor assembly. Also, it should be noted that the rotor halves 52, 54 may be identical in shape, for reducing manufacturing expenses related to component parts, however altering designs of the rotor halves 52, 54 are within the scope of this rotor assembly 50.

The first rotor half 52 and the second rotor half 54 may also each include a central recess 84 for receiving first and second ends of the center rotor pin 74. Also partially positioned within each recess 84 may be a spring 86, 88. The springs 86, 88 shown in FIG. 3 are torsion type springs. A torsion spring is made to offer resistance to applied torque. When deflected, a torsion spring may reduce in coil diameter, and extend in overall length. In a torsion spring, torque is the twisting action which tends to produce rotation. While torsion springs are demonstrated in FIG. 3, alternate spring assemblies would be within the scope of this rotor assembly 50. Such alternate spring assemblies may include, but are not limited to, springs that are not compression springs, such as torsion springs, extension springs, tension springs, etc. An extension spring, also known as a tension spring, is wound with initial tension which hold the coils together and offers resistance to a pulling force. Extension springs may have many different styles of ends, such as hooked, looped, or bent ends. In yet another alternate embodiment, the rotor assembly 50, which utilizes a split rotor, may even utilize a compression spring.

The torsion springs 86, 88 may be identical in shape, but are positioned in opposite directions during assembly as shown. Although identical torsion springs 86, 88 simplify the manufacture of the rotor assembly 50, it would be within the scope of this rotor assembly to include torsion springs of altering designs. Each torsion spring 86, 88 may include an uncoiled first end 90 that is seated furthest into the central recess 84. From the first end 90, the torsion spring may then include a tightly coiled section 92, such as of spiraled wire, and then an uncoiled second end 94. The uncoiled second end 94 may engage one end 58 or 62 of the contact arm 56. The contact arm 56 may be molded or otherwise formed to include a first groove 96 on the first end 56 of the contact arm 56 and a second groove 98 on the second end 62 of the contact arm 56. The second end 94 of the first torsion spring 86 may engage with groove 96 of the contact arm 56 and the second end 94 of the second torsion spring 88 may engage with the groove 98 of the contact arm 56. The engagement between the torsion springs and the grooves may include a straight portion 100 of the second end 94 lying flush with a surface of the grooves 96, 98. Alternatively, the second end 94 may hook onto or otherwise engage with the grooves 96, 98.

Figure 4:
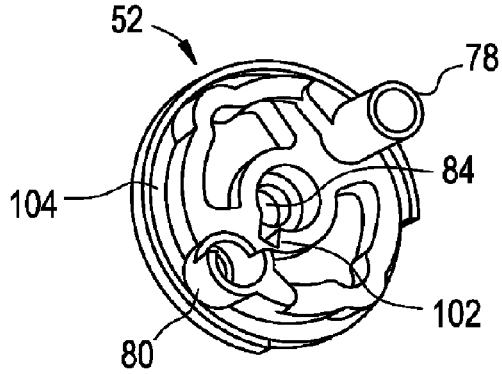
FIG. 4 depicts an exemplary rotor half.

Thus, a rotor assembly 50 has been described that is capable of "top down" assembly. A procedure that is capable of top down assembly will show a reduction in assembly time of a product, and may also be manufactured using an automated system. FIGS. 4–9 demonstrate how the rotor assembly 50 may be assembled using such a top down assembly process. FIG. 4 shows the first rotor half 52 positioned such that protrusion 78 extends outwardly and recess 84 is made available.

Figure 5:
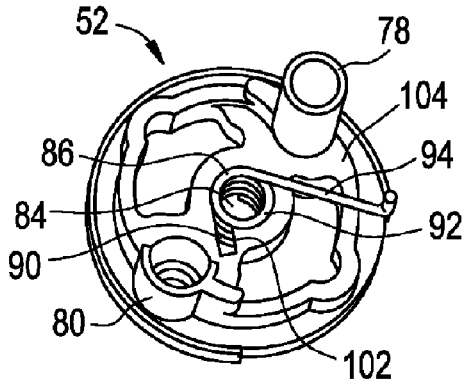
FIG. 5 depicts the rotor half of FIG. 4 with a spring.

FIG. 5 shows the first torsion spring 86 inserted within the recess 84, such that the first end 90 may be situated within a groove 102 in the first rotor half 52 extending from the recess 84. The coiled section 92 may be completely seated within the recess 84, and the uncoiled second end 94 may extend outside of the recess, and flush with an inner side 104 of the first rotor half 52. While the first end 90 of the first torsion spring 86 is restricted from movement, the second end 94 may be partially movable, and may move along with the contact arm 56.

Figure 6:
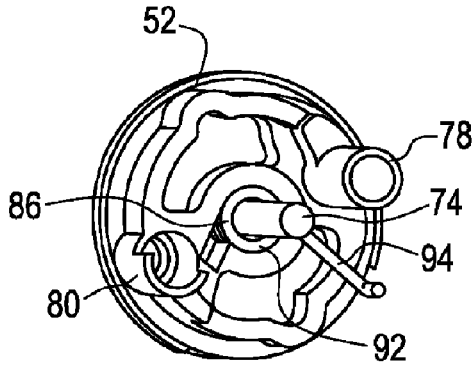
FIG. 6 depicts the rotor half and spring of FIG. 5 with a rotor center pin.

FIG. 6 shows the insertion of the rotor center pin 74 within the recess 84 such that the rotor center pin 74 is seated within the coiled section 92 of the first torsion spring 86.

Figure 7:
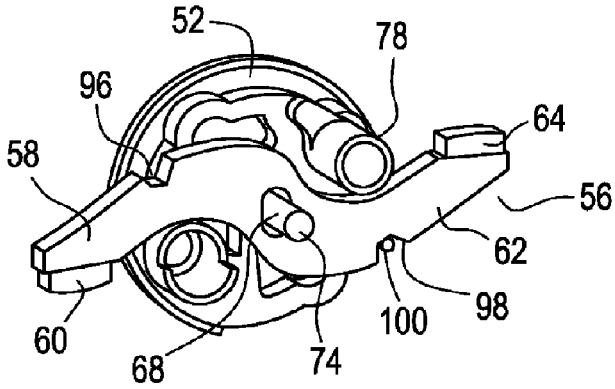
FIG. 7 depicts an exemplary contact arm installed upon the assembly of FIG. 6.

FIG. 7 shows the contact arm 56 threaded onto the rotor center pin 74 by placing the opening 68 over the rotor center pin 74. It can be seen that the opening 68 has a length L that is larger than a diameter of the rotor center pin 74. Even after a few electrical operations, there may be non-uniform erosion of the contacts. Because of the oblong shape of the opening 68, or a similar shape as previously described, the contact arm 56 can re-align itself to give uniform contact pressure on both sides of the contact arm 56. It should also be noted that the contact arm 56 is wrapped about the protrusion 78 and the receiving portion 80 such that, when fully assembled, the contact arm 56 has a limited degree of circular movement about the longitudinal axis 70. FIG. 7 also demonstrates how the straight portion 100 of the second end 94 of the first torsion spring 86 is seated up against the second contact arm 62 within the groove 98. It is noted that although this configuration is the reverse of what is shown in FIG. 2, it should be understood that either configuration would function in the same manner. That is, whether the first torsion spring 86 engages with groove 98 or groove 96 does not matter, as long as the second torsion spring 88 engages with the other of the groove 98 or groove 96, thus having one second end 94 per groove.

Figure 8:
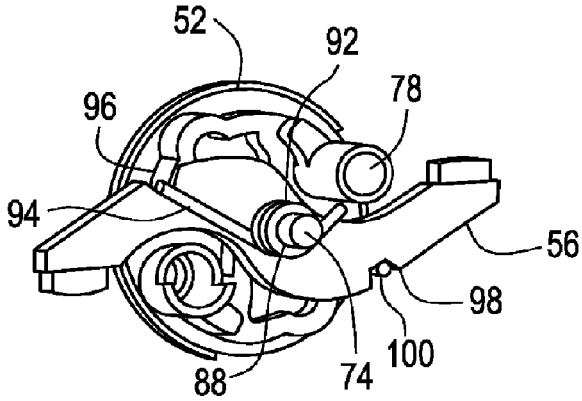
FIG. 8 depicts another spring installed upon the assembly of FIG. 7.

FIG. 8 shows the second torsion spring 88 being added to the assembly 50. The second torsion spring 88 is threaded over the rotor center pin 74 by passing the end of the rotor center pin 74 into the coiled section 92 of the second torsion spring 88. The straight portion 100 of the second end 94 of the second torsion spring 88 is seated within the groove 96.

Figure 9:
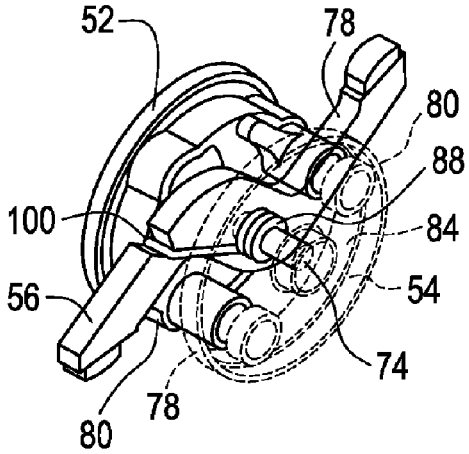
FIG. 9 depicts an exemplary second rotor half, in phantom, disposed upon the assembly of FIG. 8; and, FIG. 10 shows the rotor assembly of FIG. 9 positioned with an exemplary contact assembly.

FIG. 9 shows how the second rotor half 54 (shown in phantom) may be placed over the assembly of the first rotor half 54, first torsion spring 86, rotor center pin 74, contact arm 56, and second torsion spring 88. As previously described, the protrusion 78 of the first rotor half 52 is received in the receiving portion 80 of the second rotor half 54, and the protrusion 78 of the second rotor half 54 is received in the receiving portion 80 of the first rotor half 52. The rotor center pin 74 is seated within the recess 84 of the second rotor half 54, as is the coiled portion 92 of the second torsion spring 88. It should also be noted that the first end 90 of the second torsion spring 88 may be seated within a groove 102 extending from the recess 84 as similarly shown in FIG. 5 with respect to the first torsion spring 86 and the first rotor half 52. Also, while the first end 90 of the second torsion spring 88 may be held stationary within the second rotor half 54, the second end 94 of the second torsion spring 88 may be movable with respect to the second rotor half 54, as it moves with the contact arm 56, via the flat portion 100 engaged with the groove 96 of the contact arm 56.

Figure 10:
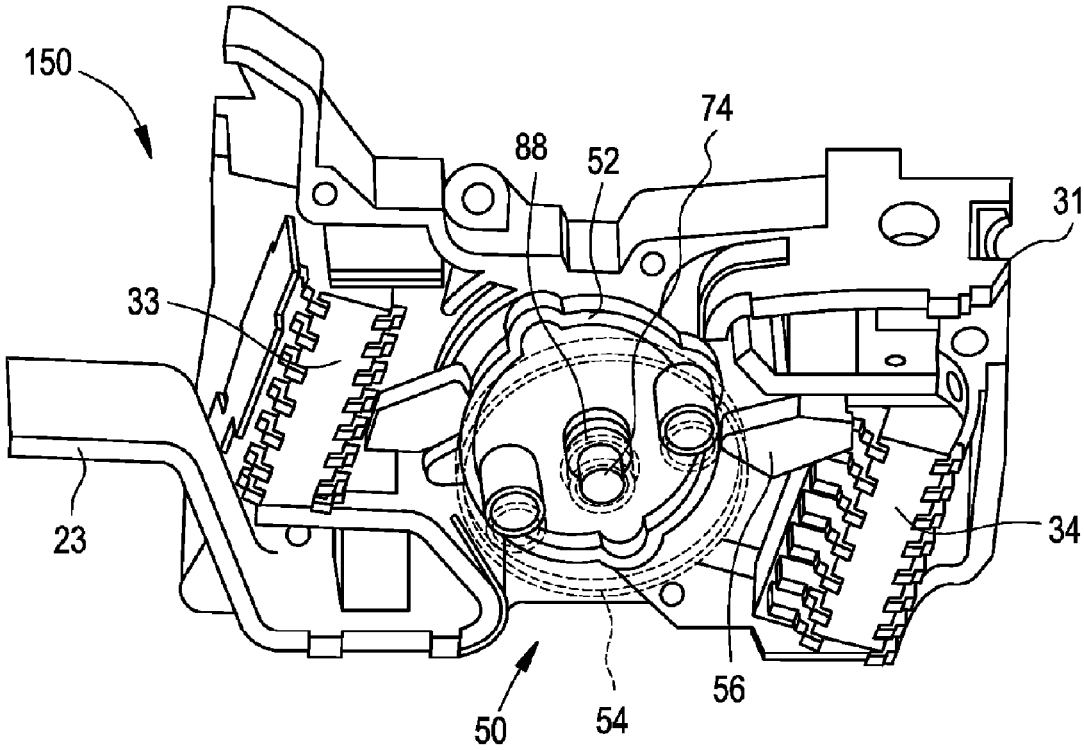

FIG. 10 shows the rotor assembly 50 positioned within a circuit breaker 150. The second rotor half 54 is again shown in phantom to reveal the second torsion spring 88, contact arm 56, and first rotor half 52.

Thus, a double break contact bridge located at the center of a two piece rotor, such as left and right side rotor halves, has been described. The center pin may be located in the oblong hole in the contact bridge and both sides in left half and right half of the rotor. The advantage of the oblong hole is, even after a few electrical operations, if there is non-uniform erosion of the contact tip, the contact bridge can re-align itself to give uniform contact pressure of both side of the bridge. The contact bridge may be loaded with the pre-determined force of a pair of springs located on both sides of the contact bridge. These springs may be located in the perpendicular direction to the axis of the center pin. The whole rotor assembly may be located in the bearing axis of the pole enclosure.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A rotor assembly comprising:

a first rotor half;

a first spring supported with the first rotor half;

a second rotor half; and, a second spring supported within the second rotor half, wherein the first rotor half and the second rotor half are adjoined with each other to enclose the first and second springs;

wherein the first rotor half includes a protrusion mating with a receiving portion on the second rotor half, the second rotor half includes a protrusion mating with a receiving portion on the first rotor half, or both.

2. The rotor assembly of claim 1 further comprising a contact arm, the contact arm sandwiched between the first spring and the second spring, wherein the first spring comprises a first end, a coiled section, and a second end, and wherein the second spring comprises a first end, a coiled section, and a second end, wherein the coiled section of the first spring and the coiled section of the second spring are coiled about an axis of rotation of the contact arm.

3. The rotor assembly of claim 2 wherein a first end of the contact arm includes a groove for receiving the second end of the first torsion spring, and a second end of the contact arm includes a groove for receiving the second end of the second torsion spring, wherein the second end of the first torsion spring and the second end of the second torsion spring are movable with the contact arm, and wherein the first end of the first spring is fixedly positioned within the first rotor half, and the first end of the second spring is fixedly positioned within the second rotor half.

4. The rotor assembly of claim 1 further comprising a contact arm, the contact arm sandwiched between the first spring and the second spring, and further comprising a rotor center pin having a diameter, wherein the contact arm includes a central portion having a non-circular opening for receiving the rotor center pin, wherein the opening ham a length that is larger than the diameter of the rotor center pin.

5. The rotor assembly of claim 4 wherein the opening is oblong.

6. The rotor assembly of claim 4 wherein, when non-uniform erosion of contacts attached to the contact arm occurs, the opening allows for re-alignment of the contact arm for ensuring uniform contact pressure on ends of the contact arm.

7. The rotor assembly of claim 1 wherein the first rotor half includes a central recess, and the second rotor half includes a central recess, wherein the first spring includes a coiled section positioned within the central recess of the first rotor half and wherein the second spring includes a coiled section positioned within the central recess of the second rotor half.

8. The rotor assembly of claim 7 further comprising a center rotor pin seated within the central recess of the first rotor half and the central recess of the second rotor half, and passing through the coiled section of the first spring and through the coiled section of the second spring.

9. The rotor assembly of claim 7 wherein the first rotor half and the second rotor half each include a groove extending from the central recesses, wherein each of the first spring and the second spring include a first end seated fixedly within the groove of the first rotor half and the groove of the second rotor half, respectively.

10. The rotor assembly of claim 1 wherein each of the protrusions and receiving portions include longitudinal apertures.

11. The rotor assembly of claim 1 wherein the first spring is not a compression spring and wherein the second spring is not a compression spring.

12. The rotor assembly of claim 11 wherein the first spring and the second spring are torsion springs.

13. The rotor assembly of claim 11 wherein the first spring and the second springs are extension springs.

14. A method for assembling a rotor assembly, the method comprising:

arranging a first rotor half wit an inner side exposing a central recess;

placing a coiled section of a first spring within the central recess;

inserting a rotor center pin within the central recess and through the coiled section of the first spring;

threading an opening of a contact arm over the rotor center pin;

threading a coiled section of a second spring over the rotor center pin;

placing a central recess of a second rotor half over the rotor center pin and the second spring; and, adjoining the first rotor half and the second rotor half with each other by mating at least one of: a protrusion on the first rotor half with a receiving portion on the second rotor half; and, a protrusion the second rotor half with a receiving portion on the first rotor half.

15. The method of claim 14 further comprising inserting a first end of the first spring within a groove extending from the central recess within the first rotor half, and inserting a first end of the second spring within a groove extending from the central recess within the second rotor half, wherein the first end of the first spring and the first end of the second spring are constrained from movement, and further comprising placing a second end of the first spring within a groove of a first end of the contact arm, and placing a second end of the second spring within a groove of a second end of the contact arm.

16. The method of claim 14 wherein threading an opening of a contact arm over the rotor center pin comprises providing an oblong opening in the contact arm.

17. A contact assembly comprising:

a first fixed contact;

a second fixed contact;

a contact arm having a first end, a second end, and a central portion;

a first movable contact attached to the first end of the contact arm and movable in and out of engagement with the first fixed contact;

a second movable contact attached to the second end of the contact arm and movable in and out of engagement with the second fixed contact;

an opening within to central portion of the contact arm, wherein the opening has a length that is longer than its width;

a first rotor half separable from and adjoined with a second rotor half, the adjoined halves configured to receive the contact arm; and, a center rotor pin passing through the opening, wherein the contact arm is rotatable about the center rotor pin;

wherein, in response to non-uniform erosion of any of the fixed or movable contacts occurring, the opening allows for re-alignment of the contact arm about the center rotor pin for ensuring uniform contact pressure between the first fixed and movable coon and between the second fixed and movable contacts; and wherein the first rotor half includes a protrusion mating with a receiving portion on the second rotor half, the second rotor half includes a protrusion mating with a rceiving portion on the first rotor half, or both.

18. The contact assembly of claim 17 further comprising a a first spring and a second spring each having a coiled section, wherein the contact arm is positioned between the first spring and the second spring, and wherein the center rotor pin passes within the coiled sections of the first and second springs.

19. The contact assembly of claim 18 wherein a first end of the first spring is seated within a groove within the first rotor half, the groove extending from a central recess of the first rotor half, and a first end of the second spring is seated within a groove within the second rotor half, the groove within the second rotor half extending from a central recess of the second rotor half, wherein the first end of the first spring and the first end of the second spring are restricted from movement, and further wherein a second end of the first spring rests within a groove within the first end of to contact arm, and a second end of the second spring rests within a groove within the second end of the contact arm, wherein the second ends of the springs move with the contact arm.

20. The contact assembly of claim 17 further comprising a first spring positioned between the first rotor half and the contact arm and a second spring positioned between the second rotor half and the contact arm, wherein the first spring and the second spring are not compression springs.

* * * * *

UNITED STATES PATENT AND TRADEMARK OFFICE

CERTIFICATE OF CORRECTION

PATENT NO. : 7,221,246 B2
APPLICATION NO. : 10/905513
DATED : May 22, 2007
INVENTOR(S) : Samir Rajauria et al.

It is certified that error appears in the above-identified patent and that said Letters Patent is hereby corrected as shown below:

Column 5:
Line 4, after "protrusion", delete "78" and insert therefor --76--;
Line 29, after "protrusion", delete "78" and insert therefor --76--;
Line 49-50, after "first rotor half", delete "54" and insert therefor --52--;
Line 52, after "protrusion", delete "78" and insert therefor --76--;
Line 54, after "protrusion", delete "78" and insert therefor --76--;

Column 7:
Line 6, after "opening", delete "ham" and insert therefor --have--;
Line 42, after "second", delete "springs" and insert therefor --spring--;
Line 45, after "half", delete "with" and insert therefor --with--;

Column 8:
Line 21, after "within", delete "to" and insert therefor --the--;
Line 33, after "movable", delete "coon" and insert therefor --contacts--;
Line 40, after "a" (1st occurrence), delete "a" (2nd occurrence).

Signed and Sealed this

Tenth Day of February, 2009

John Doll

JOHN DOLL
*Acting Director of the United States Patent and Trademark Office*